US006094566A

United States Patent [19]

Dasent et al.

[11] Patent Number: 6,094,566

[45] **Date of Patent: *Jul. 25, 2000**

[54] RETRACTABLE LANYARD WIRE/BAIL FOR A PORTABLE TELECOMMUNICATIONS DEVICE

[75] Inventors: Marlon George Dasent, Grayslake; Steven Clark Emmert, Crystal Lake, both of Ill.

[73] Assignee: Motorola, Inc., Schaumburg, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 08/950,636

[22] Filed: Oct. 15, 1997

[51] Int. Cl.[7] ..... H04Q 7/20

[52] U.S. Cl. ..... 455/90; 455/575

[58] Field of Search ..... 455/90, 575, 100, 455/351, 375, FOR 90; 379/428, 433, 434, FOR 103; 224/271, 272, 219, 220; 206/701, 320, 205; 24/3.13, 3.1, 300; 361/683, 814, 625

[56] References Cited

U.S. PATENT DOCUMENTS

| | | | |
|---|---|---|---|
| 4,461,114 | 7/1984 | Riead | 43/17.5 |
| 4,516,349 | 5/1985 | Klocksien | 43/44.87 |
| 4,517,628 | 5/1985 | McDermott | 362/186 |
| 4,845,885 | 7/1989 | Rubbelke | 43/17 |
| 5,664,015 | 9/1997 | Ford et al. | 379/428 |
| 5,690,262 | 11/1997 | Vardanega | 224/667 |
| 5,740,952 | 4/1998 | Huckenbeck | 224/271 |
| 5,841,857 | 11/1998 | Zoiss et al. | 379/428 |

FOREIGN PATENT DOCUMENTS

| | | | |
|---|---|---|---|
| 6152462 | 11/1992 | Japan | 455/90 |
| 5-218884 | 8/1993 | Japan | 455/90 |
| 2234651 | 8/1987 | United Kingdom | 455/90 |
| 2266452 | 4/1993 | United Kingdom | 455/90 |

OTHER PUBLICATIONS

NovAtel Handheld Cellular Telephone, 1989.

*Primary Examiner*—Dwayne D. Bost
*Assistant Examiner*—Jean A. Gelin
*Attorney, Agent, or Firm*—John Oskorep; Michael C. Soldner

[57] ABSTRACT

A radiotelephone (100) includes a bottom housing (108) defining a slot (1502) and a lanyard bail (1500) movably disposed through the slot (1502). The lanyard bail (1500) is movable to an extended position and a retracted position relative to the bottom housing (108).

15 Claims, 3 Drawing Sheets

RETRACTABLE LANYARD WIRE/BAIL FOR A PORTABLE TELECOMMUNICATIONS DEVICE

FIELD OF THE INVENTION

The present invention relates generally to the field of apparatus for attaching lanyards.

BACKGROUND OF THE INVENTION

Communication devices, such as pagers, have included housings with fixed posts or pins carried on the housings for attaching lanyards or wriststrap cables thereto. The fixed posts or pins are typically embedded in space-consuming recesses of the housings. Also, the fixed posts are typically either made from metal, where the posts are added during assembly, or designed as a part of the housings. As designs of communication devices get smaller, the recesses must get smaller or consume even more space (percentage-wise) in the housings. If the recesses are made smaller, it becomes increasingly difficult to attach lanyards to the housings because of the limited insertion space provided. In addition, lanyard attachments may undesirably detract from the appearances of the communication devices.

Accordingly, there is a need for an electronic device with a suitable apparatus for attaching a lanyard, and especially an apparatus that is easy to utilize and that does not detract from the appearance of the electronic device.

DETAILED DESCRIPTION OF THE PREFERRED EMBODIMENTS

As described herein, an electronic device includes a housing defining a slot and a lanyard bail movably disposed through the slot. The lanyard bail is movable to an extended position and a retracted position.

Figure 1:
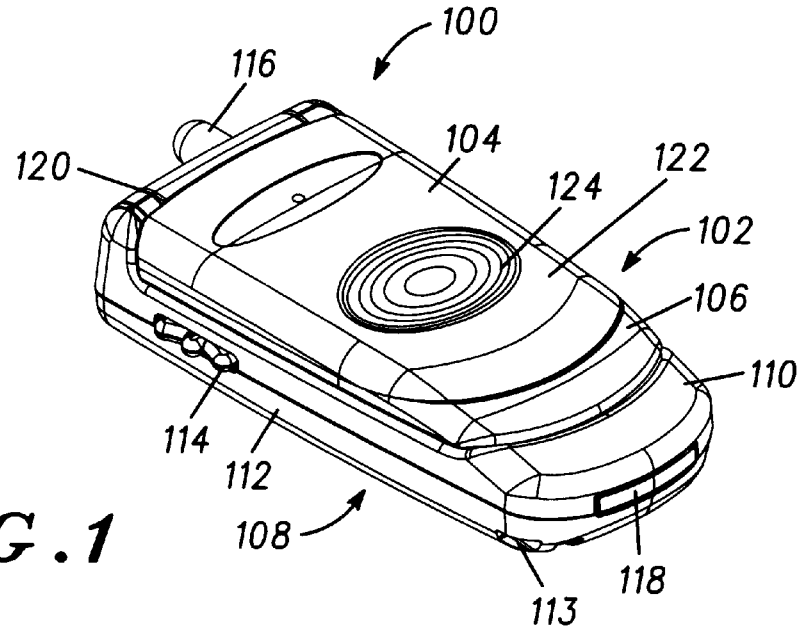
FIG. 1 is a perspective view of a radiotelephone in a closed position.

Turning to FIG. 1, a perspective view shows a radiotelephone 100 in a closed position. Radiotelephone 100 comprises a top housing 102 having a back portion 104 and a front portion 106, and a bottom housing 108 having a front portion 110 and a back portion 112. Back portion 104 of bottom housing 108 includes a first guide slot 113. Bottom housing 108 also includes a switch assembly 114 preferably on the side of radiotelephone 100 and an antenna 116 generally extending from a rear of radiotelephone 100. A connector 118 is also provided to generally enable input/output of data or provide a port for a cigarette lighter adapter. An indicator 120, such as a light guide for a light emitting diode (LED), is incorporated in a knuckle of a hinge of radiotelephone 100. Finally, back portion 104 of top housing 102 comprises a top surface 122 having a finger locator 124.

Figure 2:
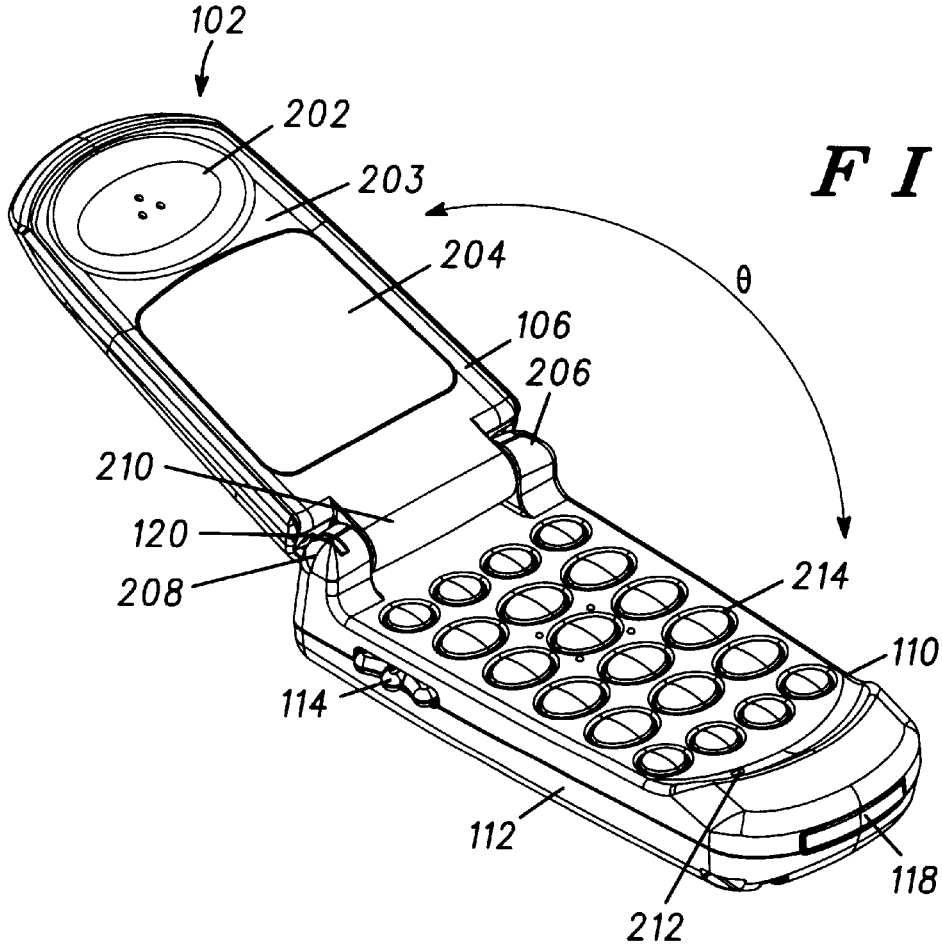
FIG. 2 is a perspective view of the radiotelephone in an open position.

Turning now to FIG. 2, radiotelephone 100 in the open position shows top housing 102 rotatably connected to bottom housing 108. Here, an angle θ of about 160 degrees is defined between top and bottom housings 102 and 108. Front portion 106 of top housing 102 comprises an earpiece 202 defined in a bottom surface 203 and a lens 204 positioned in an aperture of top housing 102. Front portion 110 of bottom housing 108 comprises a first knuckle 206 and a third knuckle 208 which are coupled to a second knuckle 210 of top housing 102. Bottom housing 108 also includes a microphone 212 disposed therein.

Figure 3:
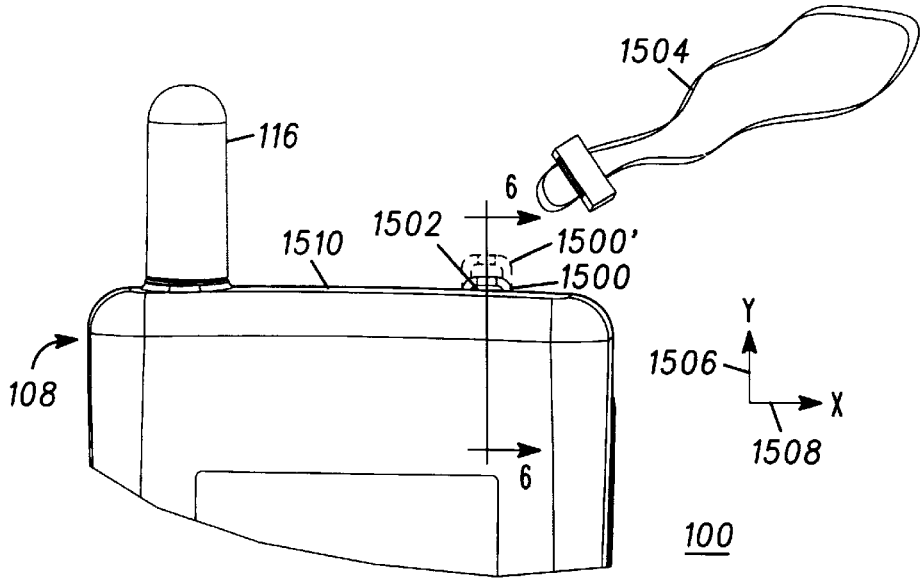
FIG. 3 is a rear plan view of a portion of the radiotelephone showing a lanyard bail movably disposed through a slot and having an extended position and a retracted position.

FIG. 3 shows a lanyard 1504 and a bottom plan view of a portion of radiotelephone 100. Radiotelephone 100 includes a lanyard bail 1500 and a slot 1502 defined by bottom housing 108 on an end 1510. In the closed position, end 1510 forms a top end of radiotelephone 100. Lanyard 1504, which typically includes a rope made from a canvas or other suitable material, is attachable to lanyard bail 1500 and has a closed end for carrying radiotelephone 100. Lanyard 1504 may be referred to as a wriststrap cable.

Lanyard bail 1500 is slidably movable to an extended position and a retracted position relative to bottom housing 108. In the embodiment shown, lanyard bail 1500 is movable in directions along a y-axis 1506 but not in directions along an x-axis 1508, and has a retracted position shown by solid lines of lanyard bail 1500 and an extended position shown by dashed lines of a lanyard bail 1500'.

Figure 4:
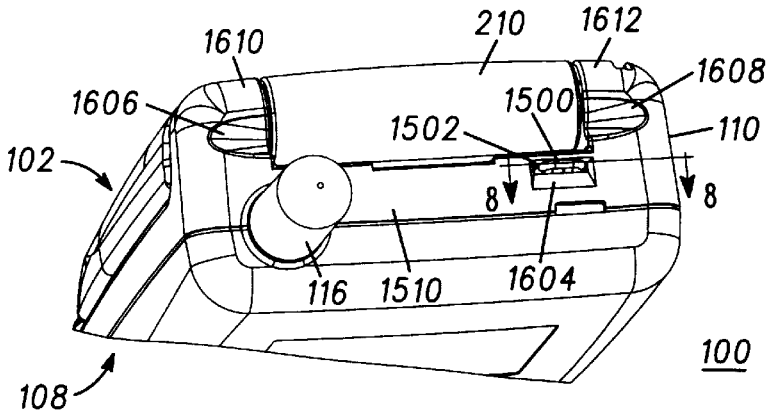
FIG. 4 is a top, rear, perspective view of a portion of the radiotelephone showing the lanyard bail in the retracted position.

FIG. 4 is a top, rear, perspective view of a portion of radiotelephone 100, showing lanyard bail 1500 positioned in the retracted position and a chamfer 1604 defined in bottom housing 108 along an outer surface thereof and an edge of slot 1502. Chamfer 1604 provides additional room to catch lanyard bail 1500 when it is in the retracted position. Thus, while being positioned out of the way when not in use, lanyard bail 1500 is easily catchable and extendible using a fingertip or a pinned instrument.

Figure 5:
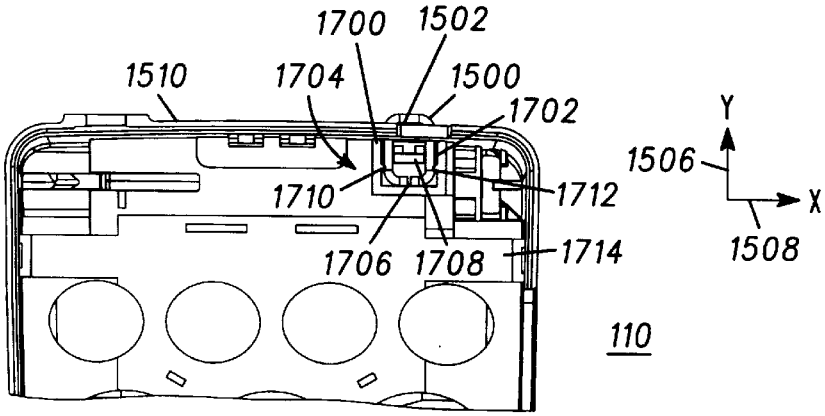
FIG. 5 is a rear plan view of a front portion of a bottom housing of the radiotelephone.

FIG. 5 is a rear plan view of a portion of front portion 110 of bottom housing 108. Front portion 110 has an inner surface 1714 defining a guide rail 1700, a guide rail 1702, a stop rib 1706, a stop rib 1708, a retention rib 1710, and a retention rib 1712. Such elements are formed from the same material as front portion 110, namely, a plastic or polycarbonate blend material, and are located within bottom housing 108 on an inside not visible to a user of radiotelephone 100. Guide rails 1700 and 1702 are substantially parallel to each other and form a track 1704 having a first end that is open and leading to slot 1502. Stop rib 1706 is positioned at a second end of track 1704 and stop rib 1708 is positioned within a center of track 1704 in between guide rails 1700 and 1702. Retention rib 1710 protrudes from guide rail 1700 within track 1704 and, likewise, retention rib 1712 protrudes from guide rail 1702 within track 1704.

Lanyard bail 1500 is made from a durable material, preferably a metal such as stainless steel. In the embodiment shown, lanyard bail 1500 is a rod formed into a substantially rectangular configuration having a length of about 5.6 mm and a width of about 4.2 mm, where the rod has a diameter of about 0.71 mm. Here, lanyard bail 1500 may be referred to as a lanyard ring, which defines a hole through which lanyard 1504 (FIG. 3) may be inserted and linked or tied to lanyard bail 1500. A small gap is provided where ends of the rod meet.

Lanyard bail 1500 is disposed within track 1704 between guide rails 1700 and 1702 around stop rib 1708. Guide rails 1700 and 1702 are sufficiently spaced to provide a close fit for lanyard bail 1500 within track 1704. Thus, lanyard bail 1500 is captured in between guide rails 1700 and 1702 and stop ribs 1706 and 1708, and is movable in directions along y-axis 1506 but not in directions along x-axis 1508. When pushed downwards toward the retracted position, lanyard bail 1500 abuts stop rib 1706 (as shown in FIG. 5). When pulled upwards toward the extended position, lanyard bail 1500 abuts stop rib 1708.

In the embodiment shown, guide rails 1700 and 1702 each have a length of about 3.7 mm and provide a spacing therebetween of about 4.5 mm (slightly greater than the width of lanyard bail 1500). Retention ribs 1710 and 1712 provide a spacing therebetween of about 3.8 mm (slightly less than the width of lanyard bail 1500). Stop rib 1708 has a length of about 2.5 mm and provides a spacing of about 1.9 mm from stop rib 1706, allowing a travel length of about 1.2 mm for lanyard bail 1500. Guide rails 1700 and 1702, stop ribs 1706 and 1708, and retention ribs 1710 and 1712 each have substantially the same heights from inner surface 1714, which is substantially the same as the diameter of the rod of lanyard bail 1500, about 0.75 mm.

Figure 6:
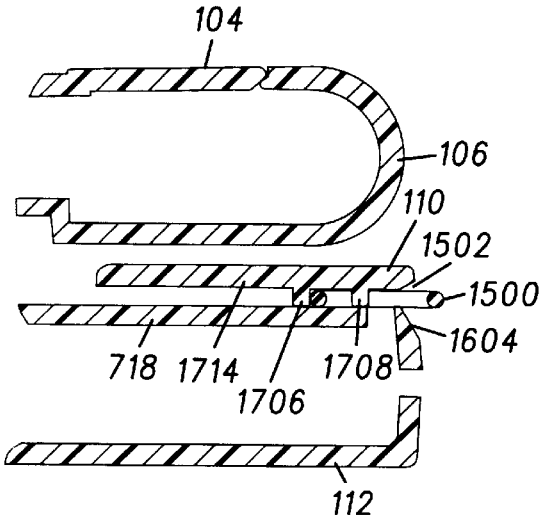
FIG. 6 is a cross section view taken along a line 6—6' of FIG. 3, showing the lanyard bail in the retracted position.
Figure 7:
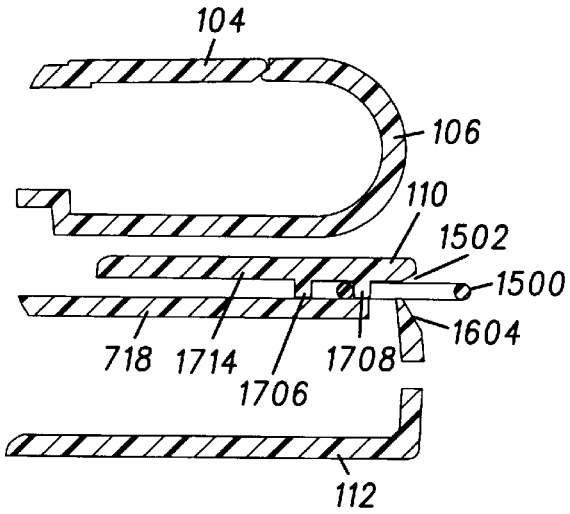
FIG. 7 is the cross section view taken along the line 6—6' of FIG. 3, showing the lanyard bail in the extended position.

FIGS. 6 and 7 are cross section views of radiotelephone 100 taken along a line 18-18' of FIG. 3, showing lanyard bail 1500 in the retracted position and the extended position, respectively. As shown, a portion of lanyard bail 1500 is captured between stop ribs 1706 and 1708, and between inner surface 1714 of front portion 110 and a logic board 718. Logic board 718 includes a substrate or a printed circuit board (PCB) disposed in bottom housing 108. For assembly, before logic board 718 is disposed in front portion 110, lanyard bail 1500 is inserted through slot 1502 from the inside of front portion 110 over and around stop rib 1708. After such insertion, logic board 718 is disposed in front portion 110 and abuts a top of track 1704, thereby capturing lanyard bail 1500 therein. Back portion 112 is secured to front portion 110 and retains logic board 718 against track 1704.

Figure 8:
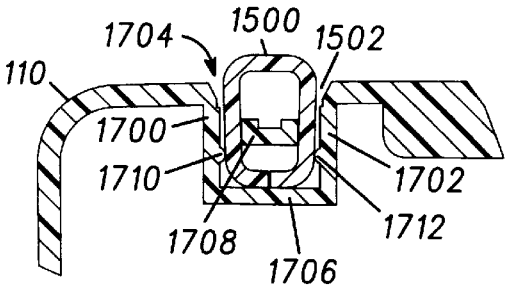
FIG. 8 is a cross section view taken along a line 8—8' of FIG. 4, showing the lanyard bail in the retracted position.
Figure 9:
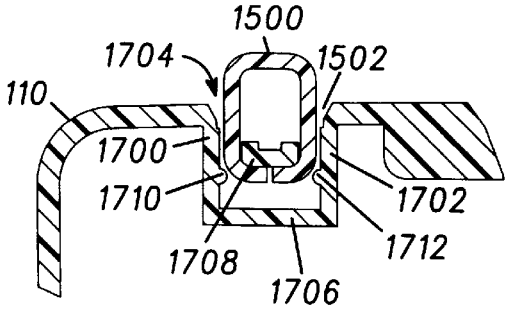
FIG. 9 is the cross section view taken along the line 8—8' of FIG. 4, showing the lanyard bail in the extended position.

FIGS. 8 and 9 are cross section views of front portion 110 and lanyard bail 1500 taken along a line 20-20' of FIG. 4, showing lanyard bail 1500 in the retracted position and the extended position, respectively. As shown in FIG. 8, retention ribs 1710 and 1712 assist in providing lanyard bail 1500 with a press fit within track 1704 in the retracted position. Here, lanyard bail 1500 gives around retention ribs 1710 and 1712 and slightly compresses where the gap becomes smaller. Thus, lanyard bail 1500 is retained or held in the retracted position when relatively small forces are applied thereto. For example, lanyard bail 1500 is retained by retention ribs 1710 and 1712 in the retracted position when radiotelephone 100 is positioned upside-down.

As shown in FIG. 9, retention ribs 1710 and 1712 are sized and positioned to provide sufficient support to carry lanyard bail 1500 in the extended position. Thus, lanyard bail 1500 is retained or held in the extended position when relatively small forces are applied thereto. For example, lanyard bail 1500 is supported in the extended position by retention ribs 1710 and 1712 when radiotelephone 100 is positioned right-side-up.

Thus, while lanyard bail 1500 and retention ribs 1710 and 1712 have a sufficient pliability to allow for movement in the extended and retracted positions in response to relatively large forces (such as those applied by a human finger), lanyard bail 1500 and retention ribs 1710 and 1712 have a sufficient stiffness to provide retention and support in response to relatively weak forces (such as gravitational forces). That is, lanyard bail 1500 has moderately fixed or retained positions in both the retracted and extended positions.

Some additional spacing is provided such that lanyard bail 1500 may not make contact with retention ribs 1710 and 1712 when fully extended. For example, lanyard bail 1500 may not make contact with retention ribs 1710 and 1712 when lanyard 1504 is attached to lanyard bail 1500 and radiotelephone 100 is being carried by lanyard 1504. Here, lanyard bail 1500 is in complete abutment with stop rib 1708.

In this embodiment, when lanyard bail 1500 is in the retracted position, a gap of about 1.2 mm exists between a top end of lanyard bail 1500 and end 1510. Thus, although lanyard bail 1500 is substantially flush with end 1510, it is not completely flush therewith. For catching lanyard bail 1500, a gap of about 1.1 mm exists between an underside of lanyard bail 1500 and chamfer 1604. A substantial portion of lanyard bail 1500 is disposed in bottom housing 108 and hidden from view when in the retracted position. When lanyard bail 1500 is in the extended position, a gap of about 1.6 mm exists between the underside of lanyard bail 1500 and end 1510, and a gap of about 2.3 mm exists between the underside of lanyard bail 1500 and chamfer 1604.

While particular embodiments of the present invention have been shown, described, and preferred, modifications may be made. For example, lanyard bail 1500 may vary in shape (U-shape, a horseshoe-shape, triangle-shape, etc.) with an accommodating construction of a housing. It is also understood that lanyard bail 1500 may vary in movement (providing partial rotation, etc.). Lanyard bail 1500 and stop ribs 1706 and 1708 may be sized and positioned such that lanyard bail 1500 is completely flush with end 1510. Finally, such apparatus may be incorporated into any electronic device or communication device such as a pager or radio. It is therefore intended in the appended claims to cover all such changes and modifications which fall within the true spirit and scope of the invention.

What is claimed is:

1. An electronic device, comprising:

a housing, said housing defining a slot;

a stop rib positioned within said slot;

a retention rib positioned within said slot; and a lanyard bail, said lanyard bail movably disposed through said slot, said lanyard bail movable to a retracted position in which said lanyard bail is fixedly retained by said retention rib to extend a first distance outside said slot and to an extended position in which said lanyard bail is fixedly retained by said stop rib and said retention rib to extend a second distance outside said slot, wherein the second distance is greater than the first distance.

2. The electronic device according to claim 1, wherein said housing further defines a chamfer positioned adjacent said slot.

3. The electronic device according to claim 1, wherein said lanyard bail comprises a lanyard ring.

4. The electronic device according to claim 1, wherein said housing further includes a track wherealong said lanyard bail is slidably disposed.

5. The electronic device according to claim 1, wherein said housing further defines a track, said lanyard bail being slidably disposed along said track toward the retracted position and the extended position.

6. The electronic device according to claim 1, wherein said lanyard bail and said slot are constructed such that when said lanyard bail is in the retracted position, a substantial portion of said lanyard bail is disposed within said housing.

7. A communication device, comprising:

a housing;

a slot defined on said housing;

a track positioned inside said housing and having a first end leading to said slot;

a stop rib positioned within said track;

a retention rib positioned within said track; and a lanyard bail, said lanyard bail slidably disposed on said track, said lanyard bail slidably extendible from said housing through said slot and moveable to a retracted position in which said lanyard bail is fixedly retained by said retention rib to extend a first distance outside said slot and to an extended position in which said lanyard bail is fixedly retained by said stop rib and said retention rib to extend a second distance outside said slot, wherein the second distance is greater than the first distance.

8. The communication device according to claim 7, wherein said stop rib is positioned at a second end of said track.

9. The communication device according to claim 8, further comprising a second stop rib positioned within said track.

10. The communication device of claim 7, wherein said retention rib provides a moderately retained position for said lanyard bail.

11. The communication device according to claim 7, wherein said lanyard bail comprises a lanyard ring.

12. The communication device according to claim 7, wherein said lanyard bail is substantially rectangular in shape.

13. A radiotelephone, comprising:

a housing, including:

a slot, said slot defined and positioned on a top end of said housing;

a first guide rail and a second guide rail, said first and said second guide rails defined on an inner surface of said housing, said first and said second guide rails forming a track having a first end leading to said slot;

a first retention rib and a second retention rib, said first retention rib extending outward from said first guide rail and said second retention rib extending outward from said second guide rail;

a first stop rib, said first stop rib defined on said inner surface and positioned at a second end of said track;

a second stop rib, said second stop rib defined on said inner surface and positioned between said first and said second guide rails; and a lanyard ring, said lanyard ring slidably disposed along said first and said second guide rails and captured between said first and second stop ribs, and moveable to a retracted position in which said lanyard ring is fixedly retained by said first and second retention ribs to extend a first distance outside said slot and to an extended position in which said lanyard bail is fixedly retained by said first and second retention ribs and said second stop rib to extend a second distance outside said slot, wherein the second distance is greater than the first distance.

14. The radiotelephone according to claim 13, wherein said housing further includes:

a chamfer, said chamfer defined on an outer surface of said housing adjacent said slot.

15. The radiotelephone according to claim 13, further comprising:

a substrate, said substrate disposed within said housing, said substrate having a portion positioned over and in contact with a top of said track.

* * * * *